US007030547B2

(12) United States Patent
Watanabe et al.

(10) Patent No.: US 7,030,547 B2
(45) Date of Patent: Apr. 18, 2006

(54) COLOR CATHODE RAY TUBE

(75) Inventors: Mitsuru Watanabe, Mutsuzawa (JP); Satoshi Muto, Mobara (JP)

(73) Assignee: Hitachi Displays, Ltd., Chiba (JP)

( * ) Notice: Subject to any disclaimer, the term of this patent is extended or adjusted under 35 U.S.C. 154(b) by 205 days.

(21) Appl. No.: 10/800,526

(22) Filed: Mar. 15, 2004

(65) Prior Publication Data

US 2004/0201344 A1 Oct. 14, 2004

(30) Foreign Application Priority Data

Mar. 20, 2003 (JP) ..... 2003-076895

(51) Int. Cl.
*H01J 29/07* (2006.01)
*H01J 29/81* (2006.01)

(52) U.S. Cl. ..... 313/407; 313/402

(58) Field of Classification Search ..... 313/407
See application file for complete search history.

(56) References Cited

U.S. PATENT DOCUMENTS 4,942,333 A * 7/1990 Knox ..... 313/402
6,552,481 B1 * 4/2003 Furusawa et al. ..... 313/407

FOREIGN PATENT DOCUMENTS

JP 08298078 A * 11/1996
JP 2002025457 A * 1/2002
JP 2003036799 A * 2/2003

* cited by examiner

*Primary Examiner*—Mariceli Santiago
(74) *Attorney, Agent, or Firm*—Milbank, Tweed, Hadley & McCloy LLP

(57) ABSTRACT

A color cathode ray tube has stress-absorbing hole patterns in skirt portions of its color selection electrode. Each of the stress-absorbing hole patterns is composed of a plurality of columns of rectangular through holes, and the columns are arranged in a lengthwise direction of the skirt portions. Each of the plurality of columns of rectangular through holes is composed of rectangular through holes arranged in a widthwise direction of the skirt portions. The relationships in shape of the rectangular through holes among outermost columns, columns next to the outermost columns, and remaining columns is optimized in the stress-absorbing hole patterns.

10 Claims, 7 Drawing Sheets

COLOR CATHODE RAY TUBE

BACKGROUND OF THE INVENTION

1. Field of the Invention

The present invention relates to a color cathode ray tube, and more particularly to a color cathode ray tube which can prevent deformation of a color selection electrode, such as a shadow mask, by adjusting the strength of a mask skirt portion.

2. Description of the Related Art

In a color cathode ray tube, for example, a shadow mask type color cathode ray tube used in a color television set, or a color display monitor for an OA (Office Automation) equipment terminal, a vacuum envelope is comprised of an approximately rectangular panel portion having a screen formed of a large number of phosphor films coated in a dot pattern or a stripe pattern on an inner surface of the panel portion, an approximately cylindrical neck portion which houses an electron gun and an approximately truncated-cone-shaped funnel portion which connects the neck portion and the panel portion. A color selection electrode (hereinafter referred to as "a shadow mask") having a large number of electron beam apertures is closely spaced from the phosphor films within the vacuum envelope, and is fixed to a mask frame.

Generally aluminum killed steel is used as a constituent material of shadow masks, and along with the demand for high definition for color cathode ray tubes, shadow masks have also been used which are shaped by press-forming thin sheet metals. In color cathode ray tubes employing a shadow mask fabricated from a thin sheet metal, a phenomenon easily occurs in which a portion of the shadow mask is thermally deformed during operation and electron beam spots are displaced from their intended positions on a phosphor screen, and this phenomenon is referred to as "mask doming." As countermeasures against such a phenomenon, along with improvement of a shadow mask suspension mechanism, Invar (a trademark, 36% Ni, 64% Fe) may also be used as a constituent material in view of its thermal expansion coefficient and physical hardness.

Such a shadow mask is fabricated by etching a large number of electron beam apertures through a blank sheet of about 0.1 to about 0.3 mm in thickness at specified positions, then stamping out a specified shape out of the blank sheet, and thereafter press-forming the blank sheet into a shape having an approximately spherical major surface and a skirt portion continuous with a periphery of the major surface an bent from the major surface in the tube axis direction. This shadow mask is welded and fixed to the mask frame as a shadow mask assembly, and is suspended from an inner wall of the panel portion.

FIG. 12 to FIG. 15 are explanatory views of one example of a shadow mask assembly in which a shadow mask and a mask frame are fixed together, wherein FIG. 12 is a side view of the shadow mask assembly, FIG. 13 is a plan view thereof, FIG. 14 is a cross-sectional view of an essential part of the shadow mask assembly showing positions where the shadow mask and the mask frame are fixed together, and FIG. 15 is a perspective view of a corner portion of the shadow mask assembly.

The shadow mask 5 is welded to the mask frame 6 at positions denoted by "x" marks of tongue portions 52 and the skirt portion 51, with the skirt portion 51, the tongue portions 52 and corner notches 58 fitted within the mask frame 6. In this configuration example, a spring 7 is welded to each side of the mask frame 6.

In the conventional shadow mask, its major surface and skirt portions are shaped by press-forming, spring back occurs in the press-formed skirt portion. In the skirt portion where the spring back has occurred, its end portion deflects in a direction away from the longitudinal axis of a cathode ray tube. There is a tendency that the amount of the deflection of the skirt portion is usually small at its corner portions where the degree of drawing by press-forming is relatively large, and the amount of the deflection of the skirt portion is large at central portions of its sides where the degree of drawing by press-forming is relatively small.

When the amount of the deflection of the skirt portion is increased, in operation of fitting the skirt portion into the support frame and then welding the fitted portion to the support frame, a large amount of the deflection hampers the fitting and welding operation, and consequently, workability in the fitting and welding operation is lowered.

Further, in the case of the conventional shadow mask, when the skirt portion having a large amount of the deflection is forcibly fitted into the support frame, a stress imparted to the fitted skirt portion is transmitted to non-apertured and apertured portions of the major surface and as a result a surface curvature of the apertured portion of the major surface of the shadow mask is deformed. Consequently, there arise problems such as lowering of the color selection performance of the shadow mask and lowering of the strength of the shadow mask.

Conventionally, various countermeasures have been taken for preventing the deformation of shadow masks. For example, there has been known a method which locally decreases a thickness of a peripheral portion of the major surface portion of the shadow mask. JP-A-9-35657 discloses a technique which copes with the deformation of the shadow mask by forming a plurality of stress absorbing holes in a skirt portion of a shadow mask. Further, many patent publications disclose various techniques which decrease the thickness of the shadow mask by forming non-through holes or grooves in regions ranging from peripheries of a major surface to a skirt portion.

Further, there has also been known a technique in which, for preventing landing errors attributed to the thermal expansion of a shadow mask, tongues are provided which project from the skirt portion substantially in parallel with the tube axis away from the major surface, and the tongues are fixed to the mask frame.

FIG. 16 and FIG. 17 are explanatory views of a typical conventional example of a shadow mask before press-forming and after press-forming. FIG. 16 is a plan view of a shadow mask blank before press-forming and FIG. 17 is a side view of the press-formed shadow mask. The shadow mask blank 5P includes a major surface 50 formed with electron beam apertures and skirt portions 51 and 54 around the major surface 50. The skirt portions 51 are arranged along long sides of the shadow mask 5 and the skirt portions 54 are arranged along short sides of the shadow mask 5. Tongue portions 52, 55 are formed in outer peripheries of respective central portions of the skirt portions 51 and 54, and corner notches 58 are formed between end portions of the skirt portion 51 and the skirt portion 54.

Formed in the skirt portions 51, 54 are elliptical openings 56, 57 larger compared to electron beam apertures formed in the major surface 50. These elliptical openings 56, 57 constitute a stress absorbing pattern which weakens the strength of the skirt portions 51, 54. The elliptical openings 56, 57 are made smaller with increasing distance from the tongue portions 52, 55. Due to the provision of these elliptical openings 56, 57, the strength of the skirt portions 51, 54 is weakened so that the deformation of he shadow mask 5 fixed to a mask frame can be suppressed. Here, the stress absorbing pattern is not limited to that of elliptical holes shown in FIG. 16, and may be formed of circular holes or slits.

SUMMARY OF THE INVENTION

It is expected that the technique disclosed in JP-A-9-35657 reduces springback to some extent compared with a case not adopting this type of technique. However, with the conventional techniques which decrease the thickness of portions of the skirt portions ranging from the peripheries of the major surface, or perforate through holes only in the skirt portions, the reduction of the springback is limited or insufficient, and in the case of a shadow mask having a major surface large in radius of curvature, it is difficult for the conventional techniques to reduce springback.

Further, in the case of the conventional technique in which tongues are provided which project from the skirt portion substantially in parallel with the tube axis away from the major surface, and the tongues are fixed to the mask frame, other problems arise in that the reduction of the springback of the skirt portion is difficult, and that the tongues fixed to the mask frame are deformed during a heating step or the like in a manufacturing process of the color cathode ray tubes and this deformation induces the deformation of the major surface. Accordingly, this conventional technique requires further improvement.

It is difficult to form the above-explained stress-reducing pattern comprised of large-diameter holes in a shadow mask blank by using a method intended for making tapered electron beam apertures in the major surface by etching the mask blank from both sides at the same time. The reason for this will be explained briefly without going into details. When the mask blank is etched to form large-diameter openings from both sides at the same time, fragments etched off from the openings block electron beam apertures. Accordingly, in a case in which such large-diameter holes are formed by etching, it was necessary to repeat etching twice. In the method by repeating etching twice, when one surface of a mask blank is subjected to an etching operation, the other surface of the mask blank needs to be covered with an etch-resistant film, and therefore this increases the number of process steps, resulting in increase in mask fabrication cost. This has been one of problems to be solved.

Further, in a case in which the above-mentioned stress-reducing pattern comprised of large-diameter holes are formed in the skirt portions, there is a problem in that breaking occurs in the vicinities of elliptical openings 56, 57 in the skirt portions at the time of press-forming the mask blank into a shadow mask. There has been a demand for solving this problem.

Occurrence of springback in skirt portions of a shadow mask causes deformation in the major surface of the shadow mask at the time of fitting the springback-caused skirt portions into a frame, as explained above. For the purpose of suppressing deformation of the major surface of the shadow mask, it is necessary to reduce the amount of springback occurring in skirt portions of the press-formed shadow mask. To suppress occurrence of springback, stress-reducing hole patterns are formed in the skirt portions, that is, the physical strength of the skirt portions is weakened by forming through holes or the like in the skirt portions. However, if the physical strength of the skirt portions is weakened by forming the stress-reducing hole patterns in the skirt portions, breaking sometimes is caused in the skirt portions at the time of press-forming the mask blank into a desired shape.

Accordingly, it is an object of the present invention to provide a color cathode ray tube having formed stress-reducing hole patterns in skirt portions of its shadow mask capable of preventing the deformation of a major surface of the shadow mask and the breaking of the skirt portions at the same time.

To achieve the above-mentioned object, according to the present invention, a stress-reducing hole pattern formed in skirt portions of a shadow mask is configured such that the stress-reducing hole pattern includes a plurality of through holes comprised of a plurality of columns of through holes, the columns being arranged in a lengthwise direction of the skirt portions, each of the plurality of columns of through holes is comprised of through holes arranged in a widthwise direction of the skirt portions, and that the following inequalities are satisfied: $SL1<SL2<SL3$, $SW1<SW2<SW3$, $BH1>BH2>BH3$, $BV1>BV2>BV3$, where SL1, SL2 and SL3 are lengths of long sides of rectangular through holes in outermost columns, columns next to the outermost columns, and remaining columns, of the plurality of columns, respectively, SW1, SW2 and SW3 are lengths of short sides of rectangular through holes in the outermost columns, the columns next to the outermost columns, and the remaining columns, of the plurality of columns, respectively, BH1, BH2 and BH3 are vertical bridge widths between adjacent ones of the rectangular through holes in the outermost columns, the columns next to said outermost columns, and the remaining columns, of the plurality of columns, respectively, and BV1, BV2 and BV3 are a horizontal distance between adjacent ones of the rectangular through holes in the outermost columns and the columns next to the outermost columns, a horizontal distance between adjacent ones of the rectangular through holes in the columns next to the outermost columns and columns adjacent to the columns next to the outermost columns, in the remaining columns, and a horizontal distance between adjacent ones of the rectangular through holes in adjacent ones of the remaining columns, respectively.

The representative configurations of the present invention are as follows:

In accordance with an embodiment of the present invention, there is provided a color cathode ray tube comprising: a vacuum envelope having an approximately rectangular panel portion having a phosphor film formed on an inner surface thereof, a neck portion housing an electron gun and a funnel portion which connects the neck portion and the panel portion; an approximately rectangular color selection electrode having a major surface which faces the phosphor film and in which a plurality of electron beam apertures are formed, and skirt portions which are formed in a shape of a frame by being bent toward the neck portion from peripheries of long sides and short sides of the major surface; and a mask frame which holds the skirt portions of the color selection electrode by being welded to the skirt portions, wherein the color selection electrode includes a plurality of rectangular through holes in the skirt portions, the plurality of rectangular through holes are comprised of a plurality of columns of rectangular through holes, said columns being arranged in a lengthwise direction of corresponding ones of the skirt portions, and each of the plurality of columns of through holes is comprised of rectangular through holes arranged in a widthwise direction of the corresponding ones of the skirt portions, and wherein the following inequalities are satisfied:

$$SL1<SL2<SL3,\ SW1<SW2<SW3,\ BH1>BH2>BH3,\ BV1>BV2>BV3,$$

where SL1, SL2 and SL3 are lengths of long sides of rectangular through holes in outermost columns, columns next to said outermost columns, and remaining columns, of said plurality of columns, respectively, SW1, SW2 and SW3 are lengths of short sides of rectangular through holes in said outermost columns, said columns next to said outermost columns, and said remaining columns, of said plurality of columns, respectively, BH1, BH2 and BH3 are vertical bridge widths between adjacent ones of said rectangular through holes in said outermost columns, said columns next to said outermost columns, and said remaining columns, of said plurality of columns, respectively, and BV1, BV2 and BV3 are a horizontal distance between adjacent ones of said rectangular through holes in said outermost columns and said columns next to said outermost columns, a horizontal distance between adjacent ones of said rectangular through holes in said columns next to said outermost columns and columns adjacent to said columns next to said outermost columns, in said remaining columns, and a horizontal distance between adjacent ones of said rectangular through holes in adjacent ones of said remaining columns, respectively.

Further, in accordance with another embodiment of the present invention, the plurality of rectangular through holes may be formed in the skirt portions at the short sides of the major surface, or at both the short and long sides of the major surface.

Still further, in accordance with another embodiment of the present invention, the plurality of columns of rectangular through holes may be divided into a plurality of collections in corresponding ones of the skirt portions, an area not formed with holes may be provided between adjacent ones of the plurality of collections, and the plurality of rectangular through holes may be disposed clear of locations of the skirt portions welded to the mask frame.

Further, in accordance with another embodiment of the present invention, rectangular through holes in one of the rectangular through hole columns may be offset in the widthwise direction of the skirt portions from rectangular through holes in adjacent ones of the rectangular through hole columns.

Further, in accordance with another embodiment of the present invention, the columns of rectangular through holes are arranged in parallel with each other to extend a distance in a range of from 50% to 98% of a length of corresponding sides of the skirt portions, and extend a distance in a range of from 30% to 98% of a width of corresponding sides of the skirt portions.

Further, the rectangular through holes may have a shape similar to a shape of the electron beam apertures formed in the major surface, and long sides of the rectangular through holes may be aligned with the widthwise direction of the skirt portions.

Here, it is needless to say that the present invention is not limited to the above-mentioned configurations and the configurations of the embodiments described later, and that various modification may be made without departing from the technical concepts of the present invention.

DESCRIPTION OF THE PREFERRED EMBODIMENTS

Figure 1:
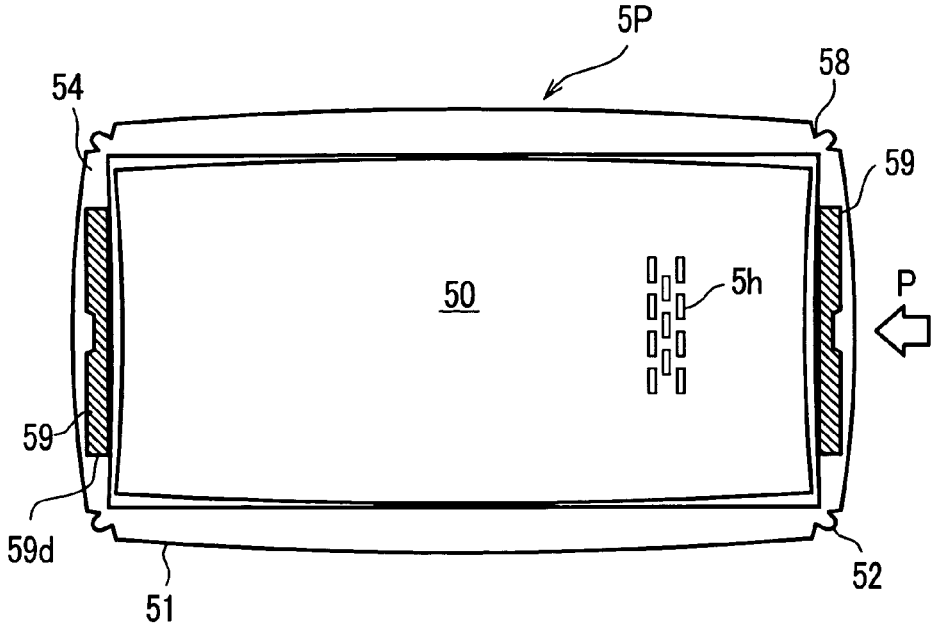
FIG. 1 is a schematic plan view of a shadow mask blank before being press-formed, for explaining one embodiment of a shadow mask used in a color cathode ray tube of the present invention.
Figure 2:
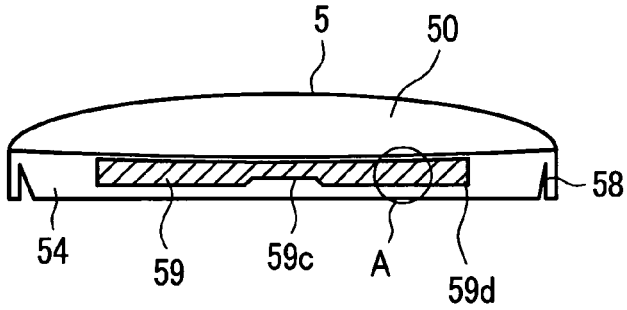
FIG. 2 is a schematic side view of a press-formed shadow, mask as viewed in the direction of arrow P in FIG. 1.

Embodiments of the present invention will be explained in detail by reference to drawings. FIG. 1 and FIG. 2 are explanatory views of a shadow mask before and after being press-formed for explaining one example of a shadow mask used in a color cathode ray tube of the present invention. FIG. 1 is a schematic plan view of a shadow mask blank before being press-formed, and FIG. 2 is a schematic side view of the shadow mask in a press-formed state as viewed in the direction of arrow P in FIG. 1. In FIG. 2, symbols identical to those used in FIG. 1 indicate parts having identical functions.

In FIG. 1 and FIG. 2, a shadow mask blank 5P includes skirt portions 51, 54 around a major surface 50 in which rectangular electron beam apertures 5*h* are formed. The skirt portion 51 is formed along long sides of the shadow mask 5 and the skirt portions 54 are formed along short sides of the shadow mask 5. Corner notches 58 are formed between adjacent end portions of the skirt portions 51 and the skirt portions 54.

Figure 3:
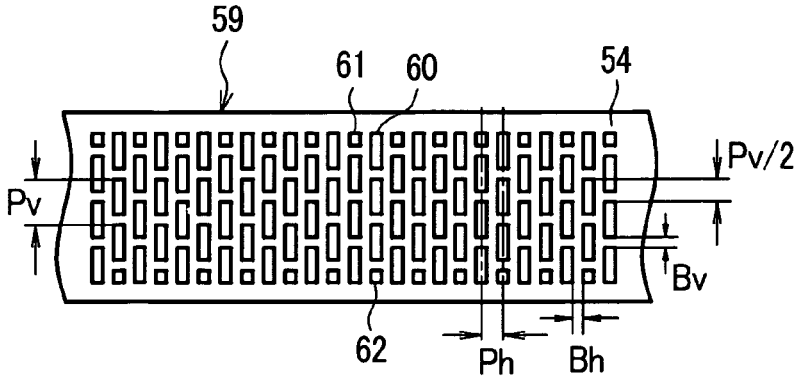
FIG. 3 is an enlarged schematic plan view of a portion A in FIG. 2.
Figure 4:
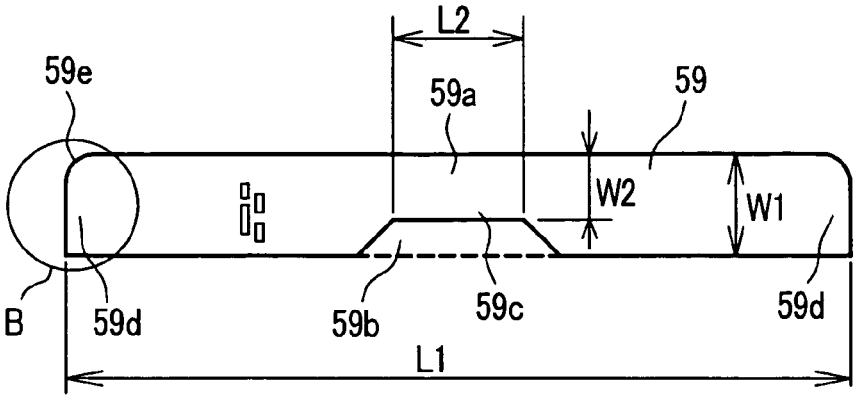
FIG. 4 is a schematic plan view of a region containing an example of a stress-absorbing hole pattern of the present invention.
Figure 5:
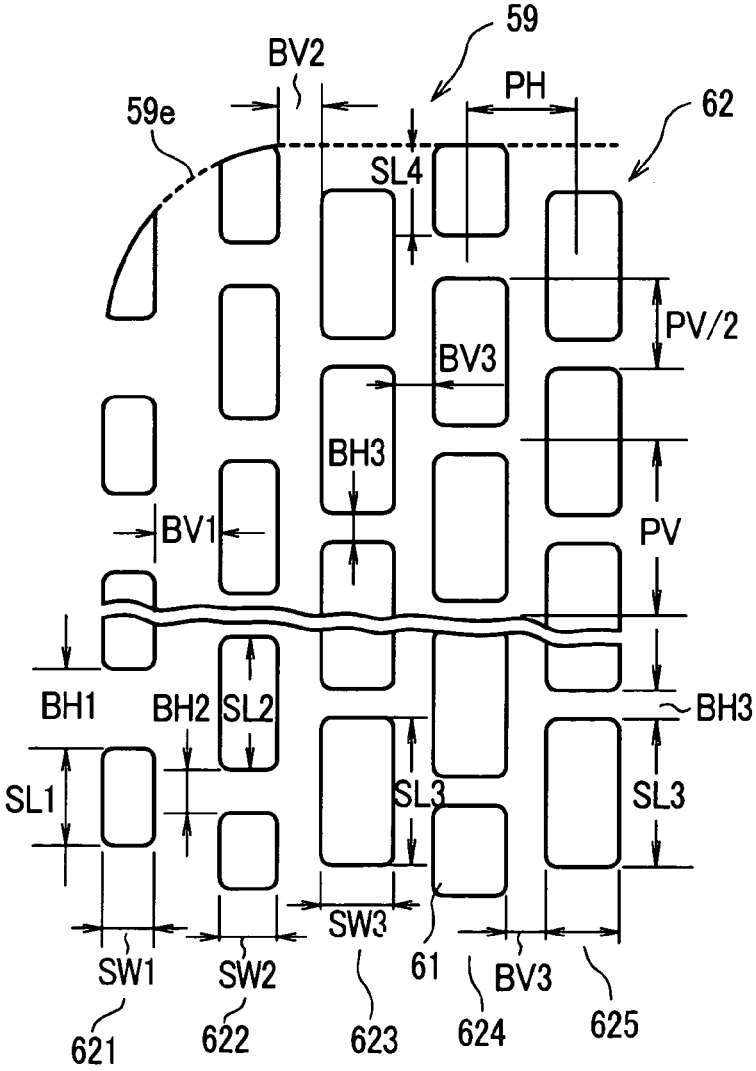
FIG. 5 is an enlarged schematic plan view of a portion B in FIG. 4.

Further, a stress-absorbing hole pattern 59 is formed in each of the skirt portions 54 at the short sides of the shadow mask, and an example of the stress-absorbing hole pattern 59 is shown in detail in FIGS. 3 to 5.

Here, FIG. 3 is an enlarged schematic plan view of a portion A of the stress-absorbing hole pattern 59 shown in FIG. 2, FIG. 4 is a schematic plan view of a region containing the stress-absorbing hole pattern 59, and FIG. 5 is an enlarged schematic plan view of a portion B in FIG. 4.

In the stress-absorbing hole pattern 59, a through hole column 62 is comprised of a plurality of rectangular through holes 60 or 61 arranged with a specified pith (a vertical slot pitch) Pv with a bridge Bv interposed therebetween in the widthwise direction (a height direction) of the skirt portion 54, and a plurality of the through hole columns 62 are arranged with a specified pitch (a horizontal slot pitch) Ph in the lengthwise direction of the skirt portion 54 with a bridge Bh interposed therebetween. Further, an area of a hole in the stress-absorbing hole pattern 59 is selected to be larger than that of an electron beam aperture 5*h* in the major surface 50. Further, through holes in one of the columns 62 are offset by half the vertical slot pitch in the width direction of the skirt portion 51 from through holes in adjacent ones of the columns 62. In FIG. 4, symbol L1 indicates a total length of the stress-absorbing hole pattern 59 and symbol W1 indicates a width of the stress-absorbing hole pattern 59.

Further, the number of through hole columns, an interval between adjacent through hole columns and the like of the stress-absorbing hole pattern 59 are optimized based on parameters such as the size, mask blank thickness and the like of the shadow mask.

It was experimentally confirmed that the preferable value of the overall length L1 of the stress-absorbing pattern is in a range of from 50% to 98% of the length of corresponding sides of the skirt portions, and that the preferable value of the width W1 of the stress-absorbing pattern is in a range of from 30% to 98% of the width of corresponding sides of the skirt portions.

Further, the stress-absorbing hole pattern 59 is provided with a narrow-width portion 59*c* in the vicinity of its center portion 59*a* so as to be get clear of a welding region 59*b* (L2 in length and W2 in width) to be welded to the mask frame 6. However, it is not always necessary to provide the narrow-width portion 59*c*.

Further, by way of example, as shown in FIGS. 4 and 5, in this stress-absorbing hole pattern 59, the through hole sizes are graded to smaller diameter at the end portions 59*d* in the lengthwise direction of the skirt portions 54.

That is, the outermost through hole column 621 of the stress-absorbing hole pattern 59 includes rectangular holes and modified holes. The rectangular holes have long sides thereof in the widthwise direction of the skirt portion 54 and a plurality of the rectangular holes are arranged in the widthwise direction. The rectangular holes in the outermost through hole column have long and short sides of lengths, SL1 and SW1, respectively, are separated from each other by a vertical-direction bridge width BH1, and are separated from rectangular holes in the adjacent column by a horizontal-direction bridge width BV1.

Further, the second through hole column 622 adjacent to the outermost through hole column.621 includes rectangular holes and modified holes. The rectangular holes in the second through hole column have long and short sides of lengths, SL2 and SW2, respectively, are separated from each other by a vertical-direction bridge width BH2, and are separated from rectangular holes in the third column by a horizontal-direction bridge width BV2.

Further, the third through hole column 623 adjacent to the second through hole column 622 includes only rectangular holes. The rectangular holes in the third through hole column 623 have long and short sides of lengths, SL3 and SW3, respectively, are separated from each other by a vertical-direction bridge width BH3, and are separated from rectangular holes in the fourth column 624 by a horizontal-direction bridge width BV3. The through hole columns 624, 625, . . . arranged from the third through hole column 623 toward the center of the skirt portion 51 are identical in specification to the third through hole column 623.

Further, in the through hole columns, the length SL4 of the long side of the through hole 61 closest to the major surface or the periphery of the skirt portion is made shorter than the length SL3 of the long side of the other through holes so that the through hole 61 does not extend outside of the region of the stress-absorbing hole pattern 59.

Here, the vertical pitch Pv and the horizontal pitch Ph are common to all the through hole columns. The corner portions 59*e* of the stress-absorbing hole pattern 59 are rounded.

To round the corner portions 59*e*, the shape of the through holes in the first and second through hole columns 621, 622 closest to the major surface are modified so as to conform to the curve of the corner portions 59*e*.

In such a stress-absorbing hole pattern, the following dimensional relationships are satisfied:

length of the long sides: SL1<SL2<SL3, length of the short sides: SW1<SW2<SW3 bridge width in the vertical direction: BH1>BH2>BH3 bridge width in the horizontal direction: BV1>BV2>BV3.

Accordingly, there are differences in aperture ratio among through hole columns 621, 622 and 623.

The physical strength distribution along the long sides of the skirt portion is such that there is a difference in physical strength between the apertured region provided with the stress-absorbing hole pattern 59 and the non-apertured region in the vicinity of the corner portions not provided with the stress-absorbing hole pattern 59. To gradually change the physical strength in a boundary between the apertured region and the non-apertured region, the above-mentioned dimensional relationships are selected. Since there exist no abrupt changes in strength between the apertured region and the non-apertured region, occurrence of breaking of the skirt portions can be suppressed at the time of press-forming the shadow mask.

By forming the stress-absorbing hole pattern 59 in the skirt portions 54 on the short sides of the major surface, first of all, the occurrence of breaking of the skirt portions 54 is eliminated in the press-forming of the shadow mask. Further, since the strength of the skirt portions 54 is reduced, the amount of springback is reduced. Accordingly, this makes it easy to weld the shadow mask to a mask frame with clearance therebetween being minimized, thereby reducing magnetic resistance therebetween. Still further, the occurrence of deformation of the shadow can be suppressed when the skirt portions are fixed to the mask frame. It is needless to say that a color cathode ray tube employing the thus obtained shadow mask did not exhibit misregistration in color due to deformation of the major surface of the shadow mask.

Here, the stress-absorbing hole pattern 59 is formed by a single etching step simultaneously with fabrication of electron beam apertures in the major surface. Accordingly, it is preferable that the stress-absorbing hole pattern 59 is comprised of circular through holes in a case where the electron beam apertures are circular, and that the stress-absorbing hole pattern 59 is comprised of slit-shaped through holes in a case where the electron beam apertures are slit-shaped. However, it is not always necessary that the above relationship is satisfied.

According to this embodiment, it is possible to obtain a color cathode ray tube provided with a shadow mask having a stress-absorbing hole pattern capable of preventing deformation of a major surface of the shadow mask.

Figure 6:
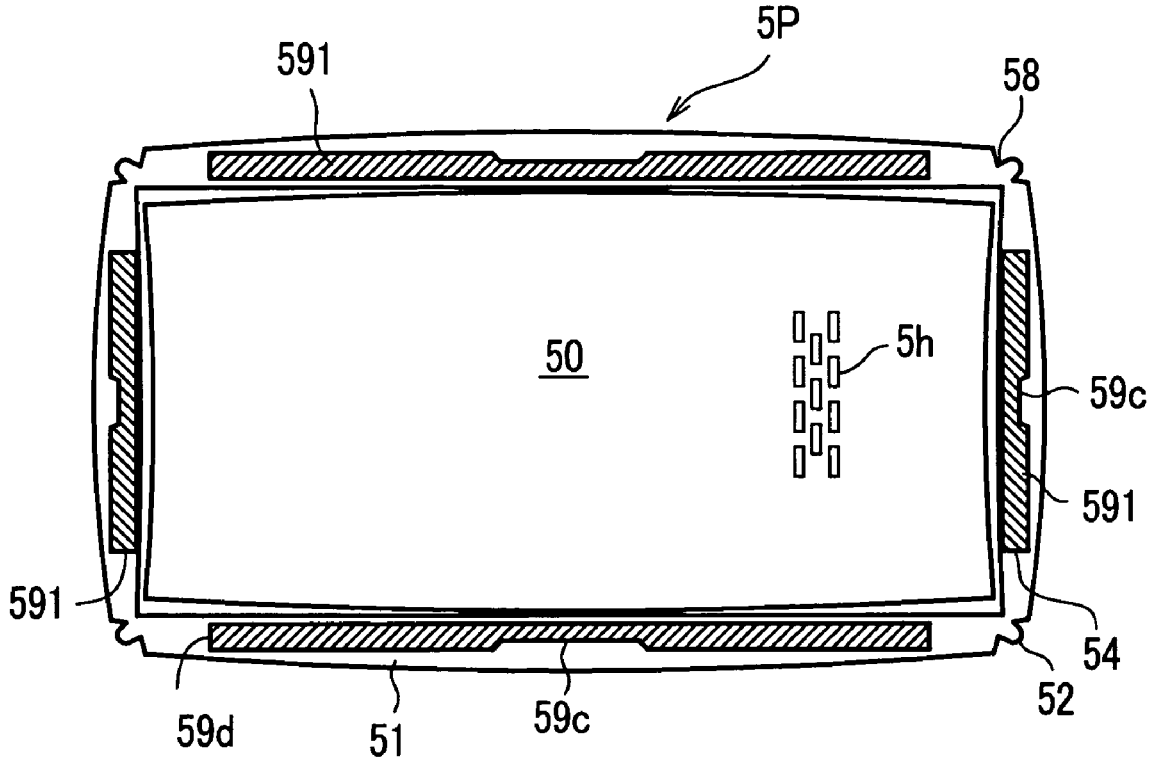
FIG. 6 is a schematic plan view of a shadow mask blank before being press-formed, for explaining another embodiment of a shadow mask used in a color cathode ray tube of the present invention.
Figure 7:
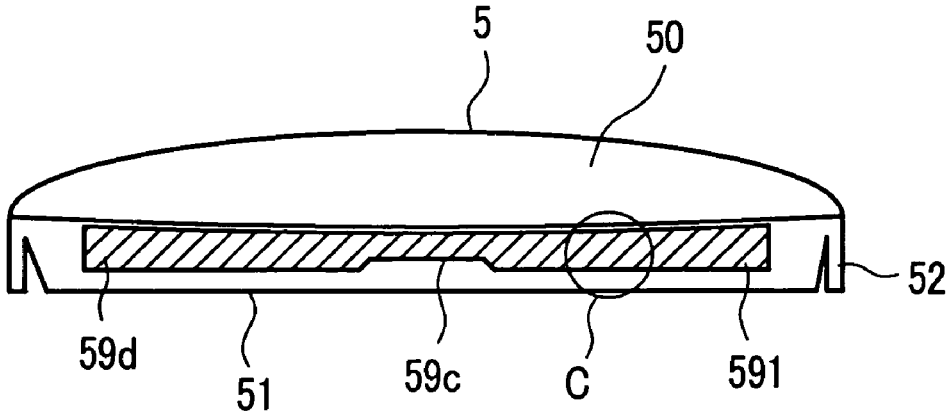
FIG. 7 is a schematic side view of the shadow mask obtained by press-forming the shadow mask blank shown in FIG. 6.

Next, FIG. 6 and FIG. 7 are explanatory views of a shadow mask before and after being press-formed for explaining another embodiment of a shadow mask used in a color cathode ray tube of the present invention. FIG. 6 is a schematic plan view of a shadow mask blank before being press-formed and FIG. 7 is a schematic side view of a shadow mask obtained by press-forming the shadow mask blank shown in FIG. 6. In FIG. 6 and FIG. 7, symbols identical to those used in the previous drawings indicate parts having identical functions.

In FIG. 6, the shadow mask blank 5P is provided with stress-absorbing hole patterns 591 formed on the skirt portions 51, 54 around the major surface 50 formed with rectangular electron beam apertures 5*h*.

Figure 8:
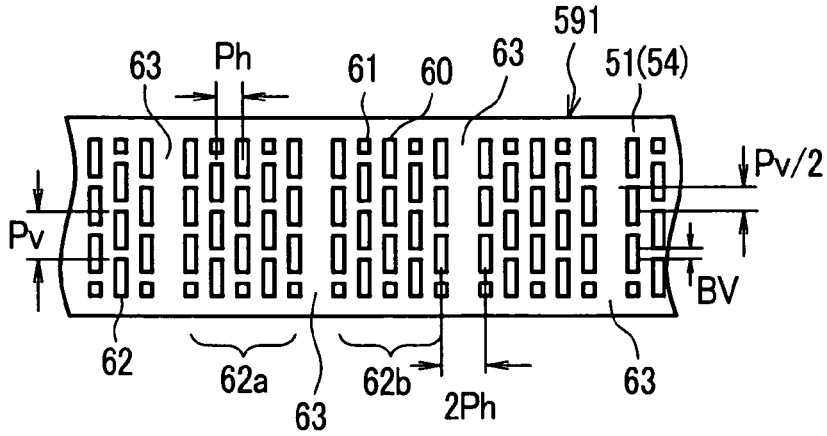
FIG. 8 is an enlarged schematic plan view of a portion C in FIG. 7.

The stress-absorbing hole pattern 591 in this embodiment is such that, as shown in FIG. 8, a non-apertured portion 63 is interposed between a collection 62*a* comprised of a plurality of through hole columns 62 and a collection 62*b* adjacent to the collection 62*a* and comprised of a plurality of through hole columns 62, and the non-apertured portions 63 and collections each comprised of a plurality of through hole columns 62 are alternately arranged. The remainder of the configuration of this embodiment is the same as in the case of the previous embodiment.

Here, FIG. 8 is an enlarged schematic plan view of a portion C of the stress-absorbing hole pattern 591 shown in FIG. 7.

The size of the non-apertured portion 63 in this embodiment is equal to the sum of an area equivalent to one through hole column 62 and one conventionally existing bridge width in the horizontal direction.

Further, the number of through hole columns 62 contained in each of the collections 62*a*, 62*b* comprised of plural through hole columns 62 depends on the size of the shadow mask, the material of the mask blank, the thickness of the mask blank and the like, and it is preferably 10 to 30 columns, and the non-apertured portions 63 may be replaced by the so-called half-etched-through structure which forms not-etched through recesses.

In this second embodiment, the interposition of the non-apertured portions 63 also provides another advantage of reducing of breaking of the skirt portions in press-forming operation.

Particularly, portions formed with the stress-absorbing hole pattern 59 are subjected to pressure such as bending, stretching or the like during both of a bulging step and a drawing step at the time of press-forming and hence, there is strong possibility that breaking occurs in the portions subjected to pressure. However, the stress-absorbing hole patterns 591 of the present invention can prevent the occurrence of breaking in the following, a specific example of the second embodiment will be explained. A shadow mask used in a 21-inch diagonal flat screen type color cathode ray tube for a color TV receiver is a slot-type shadow mask fabricated from a mask blank made of Invar and of 0.22 mm in thickness. Its aperture ratios at the center and the periphery of the major surface formed with electron beam apertures are 20% and 18%, respectively. The stress-absorbing hole patterns shown in FIG. 8 were fabricated in the respective skirt portions.

In the following the respective dimensions will be explained by referring to the symbols shown in FIG. 5.

A vertical-direction pitch Pv is set to 2.4 mm,
a vertical-direction hole length SL3 is set to 2.0 mm,
a horizontal-direction hole width SW3 is set to 1.0 mm,
a vertical-direction bridge width BH3 is set to 0.4 mm, and a horizontal-direction pitch Ph is set to 1.5 mm.

Further, hole sizes are graded at the edge portions 59*d* of the stress-absorbing hole pattern 59 such that the dimension SW1 is set to 0.6 mm, the dimension BH1 is set to 0.8 mm.

In FIG. 4, the total lengths L1 of the stress-absorbing hole patterns 59 at the long and short sides of the major surface are 340 mm and 250 mm, respectively, and the lengths L2 of the narrow-width portions 59*c* of the stress-absorbing hole patterns 59 at the long and short sides of the major surface are 35 mm and 35 mm, respectively. The widths W1 of the stress-absorbing hole pattern 59 at the long and short sides of the major surface are 11 mm and 13 mm, respectively. The widths W2 of the narrow-width portions 59*c* of the stress-absorbing hole patterns 59 are 6 mm at both the long and short sides of the major surface.

Further, in this case, the number of through hole columns contained in each of the above-explained collections comprised of plural through hole columns is 20, and a non-apertured portion 63 is interposed between adjacent ones of the collections. The width of the non-apertured portion 63 is equal to a spacing resulting from omitting formation of one column of through holes but leaving a spacing which has otherwise been occupied by the one column of through holes. That is, the width of the non-apertured portion 63 is equal to the sum of the length SW3 of a short side of the rectangular hole and double the horizontal-direction bridge width BV3. The aperture ratio of the stress-absorbing hole pattern 59 is 55% and is approximately 2.8 times as high as that of the major surface.

The aperture ratio (an apertured area per unit area) may be increased as by increasing an area occupied by through holes or decreasing the bridge width in the horizontal direction or the vertical direction.

In this embodiment, the optical transmissions are measured as the aperture ratios, in the major surface portion of the shadow mask, and in the portion containing the stress-absorbing hole pattern, respectively.

In this embodiment, the stress-absorbing hole pattern can be formed by a single etching process step. Further, occurrence of breaking in the skirt portions at the time of press-forming can be eliminated and, at the same time the amount of springback could be made very small. Further, occurrence of deformation of the major surface could be prevented at the time of welding the shadow mask to the mask frame. Still further, misregistration in color due to deformation of the major surface of the shadow mask does not occur during operation. Accordingly, prevention of both breaking and deformation of the shadow mask could be achieved satisfactorily.

According to this embodiment, it is possible to obtain a color cathode ray tube provided with a shadow mask which makes it possible to form by a single etching process step a stress-absorbing hole pattern capable of preventing deformation of a major surface of the shadow mask.

Here, an optimum aperture ratio of the stress-absorbing hole pattern is determined based on the size of the shadow mask, a material of its mask blank, the thickness of the mask blank and the like. For the purpose of preventing deformation of the major surface of the shadow mask, suppressing the amount of the springback, preventing breaking of skirt portions of the shadow mask at the time of press-forming the mask blank and the like, a practically effective aperture ratio of the stress-absorbing hole pattern is in a range of from 1.8 to 3.5 times that of the major surface of the shadow mask, and a preferable aperture ratio of the stress-absorbing hole pattern is in a range of from 2.0 to 3.0 times that of the major surface of the shadow mask.

Figure 9:
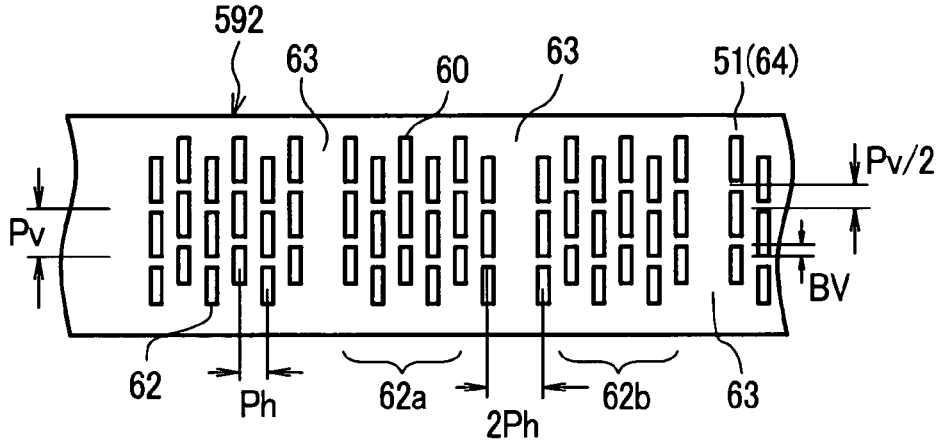
FIG. 9 is a schematic plan view similar to that of FIG. 8, showing another example of a stress-absorbing hole pattern of the present invention.
Figure 10:
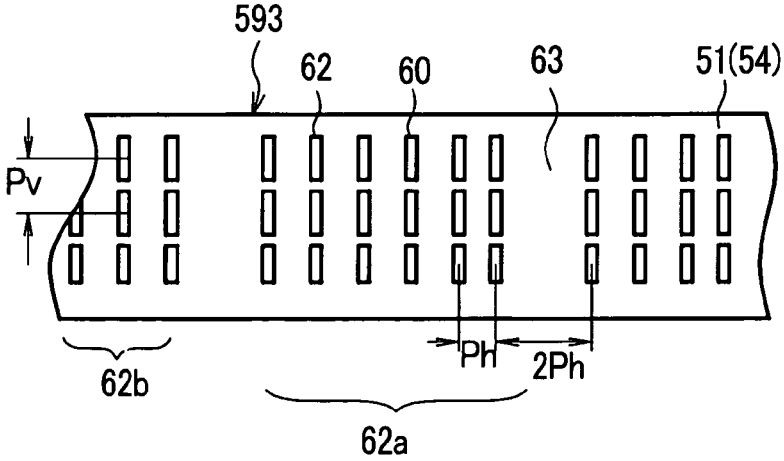
FIG. 10 is a schematic plan view similar to that of FIG. 8 of still another example of a stress-absorbing hole pattern of the present invention.

Next, FIG. 9 and FIG. 10 are schematic plan views similar to that of FIG. 8, and illustrate specific examples of a stress-absorbing hole pattern in accordance with another embodiment of the shadow mask used in the color cathode ray tube of the present invention.

First, FIG. 9 shows a stress-absorbing hole pattern 592 in which through holes 60 are formed of rectangular holes only. This pattern is formed by arranging in the widthwise direction of the skirt portion through holes of the similar shape as electron beam apertures 5*h* formed in the major surface of the shadow mask.

Here, the through holes 60 are arranged such that the long sides of the through holes 60 are aligned with the widthwise direction of the skirt portion. Through holes in one of the through hole columns are offset by half the repetition pitch of the through holes in the widthwise direction of the skirt portion from through holes in adjacent ones of the through hole columns.

Next, FIG. 10 shows a stress-absorbing hole pattern 593 which are comprised of the through holes 60 of the one and same kind of shape repeated in the lengthwise direction of the skirt portion.

Figure 11:
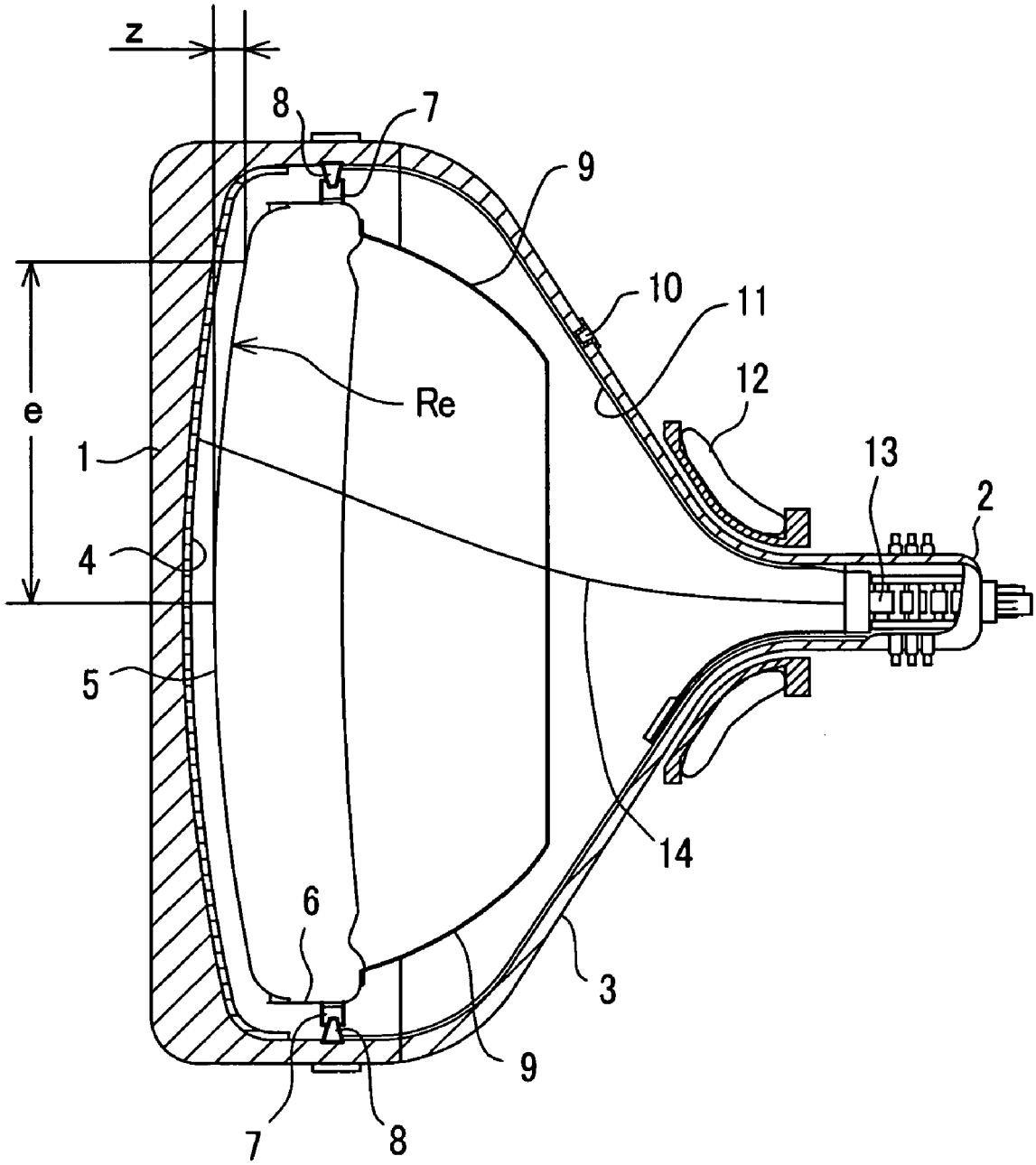
FIG. 11 is a cross-sectional view for explaining an example of the overall construction of the color cathode ray tube of the present invention.
Figure 12:
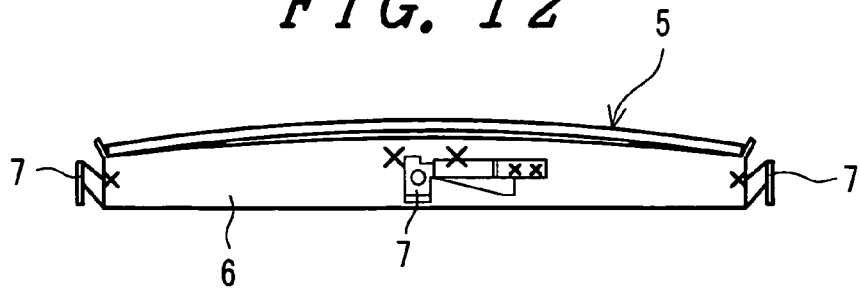
FIG. 12 is a side view of a shadow mask assembly in which a shadow mask is fixed to a mask frame.
Figure 13:
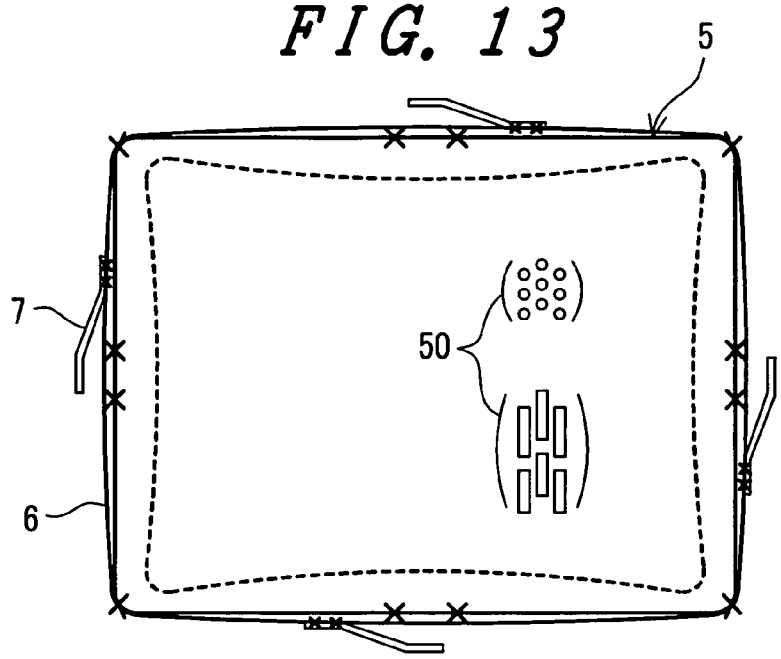
FIG. 13 is a plan view of the shadow mask assembly shown in FIG. 12.
Figure 14:
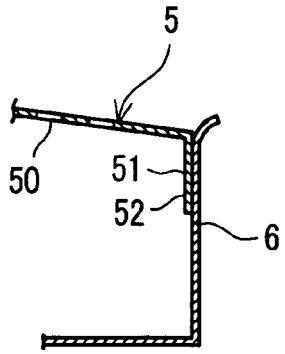
FIG. 14 is a cross-sectional view of an essential part showing positions where the shadow mask and the mask frame are fixed to each other.
Figure 15:
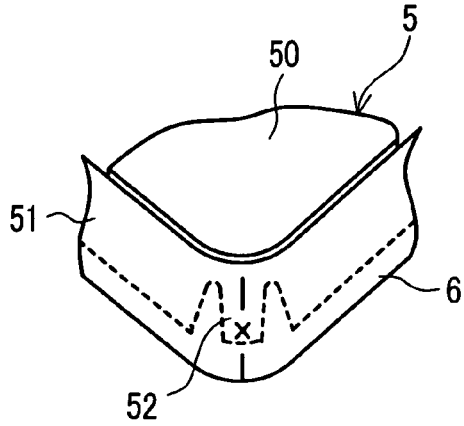
FIG. 15 is a perspective view of a corner portion of the shadow mask assembly.
Figure 16:
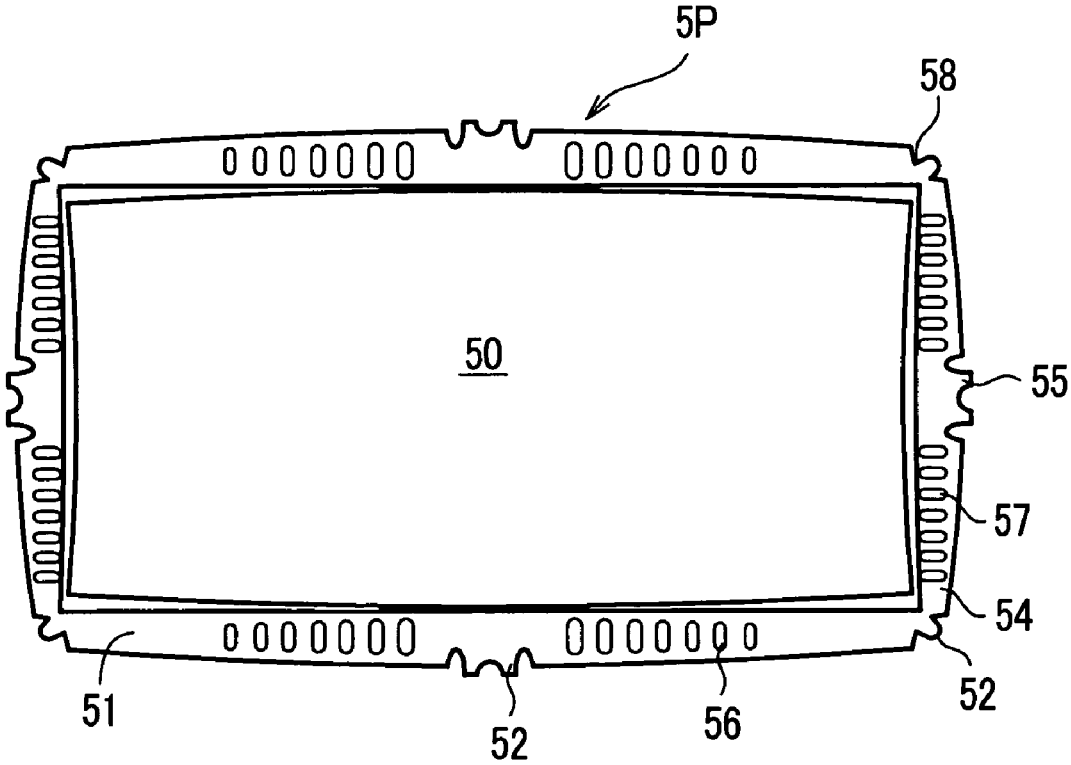
FIG. 16 (PRIOR ART)
FIG. 16 is a plan view of a conventional shadow mask blank before being press-formed.
Figure 17:
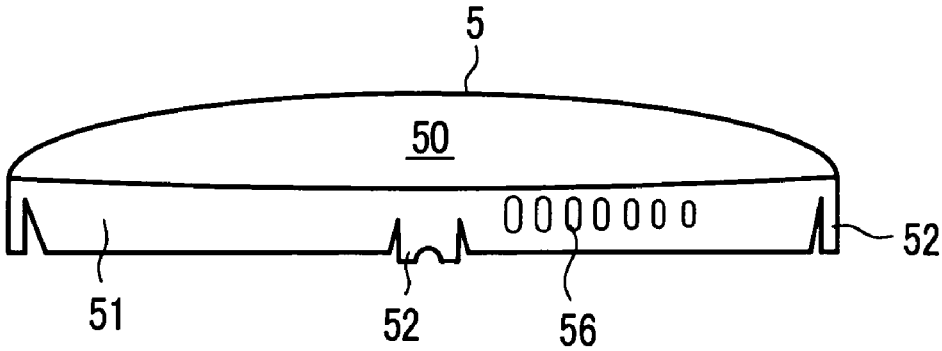
FIG. 17 (PRIOR ART)
FIG. 17 is a side view of a conventional press-formed shadow mask.

FIG. 11 is a cross-sectional view for explaining an example of an overall structure of a color cathode ray tube according to the present invention.

A vacuum envelope is formed of a panel portion 1, a neck portion 2 and a funnel portion 3. A phosphor film 4 is applied on an inner surface of the panel portion 1, and a shadow mask 5 having a large number of electron beam apertures is spaced closely from the phosphor film 4. The shadow mask 5 is fixed to a mask frame 6, and free ends of suspension springs 7 with one end thereof fixed to an outer wall of the mask frame 6 are engaged with studs 8 embedded in an inner wall of the panel portion 1.

Here, a magnetic shield 9 which shields the earth magnetism or the like is mounted on the electron-gun side of the mask frame 6. Further, reference numeral 10 indicates an anode button, reference numeral 11 indicates an internal conductive film, reference numeral 12 indicates a deflection yoke for deflecting electron beams in the horizontal and vertical directions, reference numeral 13 indicates an electron gun which emits three electron beams 14 (one center electron beam and two side electron beams).

The electron beams 14 emitted from the electron gun 13 are deflected in two directions, that is, the horizontal direction and the vertical direction, by the deflection yoke 12 which is mounted around a transition region between the neck portion 2 and the funnel portion 3. Thereafter, the electron beams 14 impinge on the phosphor film 4 through electron beam apertures formed in the shadow mask 5 which serves as a color selection electrode, thereby forming images.

Recently, along with the spread of flat-screen-type color television receiver sets and color display monitors, there is a tendency that a faceplate (a glass front constituting the panel portion 1) is also made flatter in color cathode ray tubes used in these color television receiver sets and color display monitors.

The color cathode ray tube shown in FIG. 11 is a flat-type shadow-mask type color cathode ray tube. The panel portion 1 has an approximately flat outer surface and a concave inner surface. The shadow mask 5 is obtained by press-forming a shadow mask blank to provide a specified curved surface conforming to the contour of the inner surface of the panel portion 1. Although the outer surface of the panel portion 1 is substantially flat, the inner surface of the panel portion 1 and the shadow mask 5 are curved because a method of manufacturing the shadow mask 5 by using a press-forming technique is thereby made simple and reduces cost.

In this shadow mask 5, its major surface containing an apertured region formed with a large number of electron beam apertures is approximately rectangular, and has different radiuses of curvature along its major axis, minor axis and diagonals from each other. This is intended to create a sense that a picture on the screen of the color cathode ray tube is flat and to secure the mechanical strength of the formed shadow mask at the same time. The curved surface of the shadow mask 5 shown in FIG. 11 is aspherical, and its radiuses of curvature along the major axis, the minor axis and the diagonals decrease gradually with increasing distance from the center of the major surface 21 toward the peripheries of the major surface 21. The radius of curvature Rx along the major axis varies from 1450 mm to 1250 mm, the radius of curvature Ry along the minor axis varies from 2000 mm to 1300 mm, and the radius of curvature Rd along the diagonal varies from 1600 mm to 1250 mm.

The radius of curvature of this aspheric shadow mask is defined as the following equivalent radius of curvature, Re:

$$Re=(z^2+e^2)/(2z) \quad (1)$$

where e is a distance in mm from the center of the major surface to a given position of at peripheries of the major surface, measured perpendicularly to the tube axis, and z is a distance in mm from the given position at peripheries of the major surface to a plane passing through the center of the major surface and perpendicular to the tube axis.

As described above, even when the radius of curvature along the major axis is somewhat smaller than the radius of curvature along the minor axis, this does not impair the sense that a picture on the screen is flat, and consequently, the equivalent radius of curvature Re suffices if it is 1250 mm or more.

By employing the shadow mask structure explained in the above embodiments, the present invention can provide a high-definition color cathode ray tube capable of preventing breaking of skirt portions of its shadow mask, and also displaying stable images by preventing deformation of the major surface of the shadow mask.

Here, the present invention is not limited to the above-mentioned configurations and various modifications can be made without departing from the technical concept of the present invention described in claims.

As has been explained heretofore, according to the present invention, breaking of the skirt portions can be prevented at the time of press-forming the shadow mask, springback can be suppressed and hence, the present invention can provide a high-definition color cathode ray tube capable of displaying stable images by preventing deformation of the major surface of its shadow mask caused by assembling of the shadow mask and its mask frame.

What is claimed is:

1. A color cathode ray tube comprising:

a vacuum envelope having an approximately rectangular panel portion having a phosphor film formed on an inner surface thereof, a neck portion housing an electron gun and a funnel portion which connects the neck portion and the panel portion;

an approximately rectangular color selection electrode having a major surface which faces the phosphor film and in which a plurality of electron beam apertures are formed, and skirt portions which are formed in a shape of a frame by being bent toward the neck portion from peripheries of long sides and short sides of the major surface; and a mask frame which holds the skirt portions of the color selection electrode by being welded to the skirt portions, wherein the color selection electrode includes a plurality of rectangular through holes in the skirt portions, the plurality of rectangular through holes are comprised of a plurality of columns of rectangular through holes, said columns being arranged in a lengthwise direction of corresponding ones of the skirt portions, and each of the plurality of columns of through holes is comprised of rectangular through holes arranged in a widthwise direction of the corresponding ones of the skirt portions, and wherein the following inequalities are satisfied:

$$SL1<SL2<SL3,$$

$$SW1<SW2<SW3,$$

$$BH1>BH2>BH3,$$

$$BV1>BV2>BV3,$$

where

SL1, SL2 and SL3 are lengths of long sides of rectangular through holes in outermost columns, columns next to said outermost columns, and remaining columns, of said plurality of columns, respectively, SW1, SW2 and SW3 are lengths of short sides of rectangular through holes in said outermost columns, said columns next to said outermost columns, and said remaining columns, of said plurality of columns, respectively, BH1, BH2 and BH3 are vertical bridge widths between adjacent ones of said rectangular through holes in said outermost columns, said columns next to said outermost columns, and said remaining columns, of said plurality of columns, respectively, and BV1, BV2 and BV3 are a horizontal distance between adjacent ones of said rectangular through holes in said outermost columns and said columns next to said outermost columns, a horizontal distance between adjacent ones of said rectangular through holes in said columns next to said outermost columns and columns adjacent to said columns next to said outermost columns, in said remaining columns, and a horizontal distance between adjacent ones of said rectangular through holes in adjacent ones of said remaining columns, respectively.

2. A color cathode ray tube according to claim 1, wherein the plurality of rectangular through holes are formed in the skirt portions at the short sides of the major surface.

3. A color cathode ray tube according to claim 1, wherein the plurality of rectangular through holes are formed in the skirt portions at both the short and long sides of the major surface.

4. A color cathode ray tube according to claim 1, wherein the plurality of columns of rectangular through holes are divided into a plurality of collections in corresponding ones of the skirt portions, an area not formed with holes is provided between adjacent ones of the plurality of collections, and a width of the area not formed with holes is wider than a spacing between adjacent ones of the plurality of columns of rectangular through holes in a same one of the plurality of collections.

5. A color cathode ray tube according to claim 1, wherein the plurality of rectangular through holes are disposed clear of locations of the skirt portions welded to the mask frame.

6. A color cathode ray tube according to claim 1, wherein rectangular through holes in one of the rectangular through hole columns are offset in the widthwise direction of corresponding ones of the skirt portions from rectangular through holes in adjacent ones of the rectangular through hole columns.

7. A color cathode ray tube according to claim 1, wherein the long sides of the rectangular through holes are aligned with the widthwise direction of the skirt portions.

8. A color cathode ray tube according to claim 4, wherein rectangular through holes in one of the rectangular through hole columns are offset in the widthwise direction of corresponding ones of the skirt portions from rectangular through holes in adjacent ones of the through hole columns.

9. A color cathode ray tube according to claim 4, wherein the long sides of the rectangular through holes are aligned with the widthwise direction of the skirt portions.

10. A color cathode ray tube according to claim 1, wherein said columns of rectangular through holes are arranged in parallel with each other to extend a distance in a range of from 50% to 98% of a length of corresponding sides of the skirt portions, and extend a distance in a range of from 30% to 98% of a width of corresponding sides of the skirt portions.

* * * * *